United States Patent [19]

Morck, Jr.

[11] 4,379,689

[45] Apr. 12, 1983

[54] DUAL FUEL BURNER

[75] Inventor: Charles W. Morck, Jr., Philadelphia, Pa.

[73] Assignee: Selas Corporation of America, Dresher, Pa.

[21] Appl. No.: 234,357

[22] Filed: Feb. 13, 1981

[51] Int. Cl.[3] ..... F23M 9/00

[52] U.S. Cl. ..... 431/284; 239/400; 239/405; 431/183; 431/348

[58] Field of Search ..... 431/284, 174, 348, 183, 431/186; 239/400, 404, 406, 138, 161, 162, 405

[56] References Cited

U.S. PATENT DOCUMENTS

| | | | |
|---|---|---|---|
| 3,000,435 | 9/1961 | Bloom et al. | 431/348 |
| 3,236,279 | 2/1966 | Beyer | 431/284 |
| 3,254,846 | 6/1966 | Schreter et al. | 239/400 |
| 3,425,634 | 2/1969 | Mutchler | 239/405 |
| 3,542,500 | 11/1970 | Norcross | 431/183 |
| 3,586,242 | 6/1971 | Lester | 431/183 |
| 3,684,186 | 8/1972 | Helmrich | 239/400 |
| 4,003,692 | 1/1977 | Moore | 431/284 |
| 4,221,558 | 9/1980 | Santisi | 431/183 |
| 4,243,375 | 1/1981 | Reed | 431/284 |
| 4,285,664 | 8/1981 | Voorheis | 431/284 |

*Primary Examiner*—Daniel J. O'Connor
*Attorney, Agent, or Firm*—Austin R. Miller

[57] ABSTRACT

In a burner mountable in a passageway leading into a furnace including a housing received by said passageway, having a discharge end opening into said furnace, a first conduit within said housing, a second conduit within said first conduit, said housing, said first conduit and said second conduit being annularly spaced, means for introducing respective fuels into space between said first and second conduits and into said second conduit, means for introducing air into space between said housing and said first conduit, fins for inducing swirling motion of air discharged from said housing into said furnace, means for discharging respective fuels from said first and second conduits into said furnace through said housing discharge end, the housing discharge end extending into the furnace interior, a sleeve receiving the first conduit therewithin and extending forwardly therefrom, a cap having an inwardly facing lip about a discharge end of the sleeve proximate the housing opening the lip defining a discharge through which a nozzle discharges, the nozzle being interior of and spaced annularly from the sleeve, connected to the discharge end of the second conduit, having a chamber therewithin communicating with the second conduit, the nozzle having a recess facing said housing discharge end, recess periphery contacting the lip, the nozzle having channels therewithin extending from space between the sleeve and the recess, channel orientation being defined by chords of a circle having a center at a longitudinal axis of the nozzle, having conduits connecting the chamber and the channels, the fins being recessed within the housing from the discharge ends of the nozzle.

10 Claims, 7 Drawing Figures

DUAL FUEL BURNER

BACKGROUND OF THE INVENTION

1. Field of the Invention

This invention relates to burner supplying gas or liquid fuel for combustion in a furnace.

2. Description of the Prior Art

A dual fuel burner is disclosed in U.S. Pat. No. 4,221,558.

The '558 apparatus performs well over a wide range of temperatures and fuel flow rates, using oil or gas as fuel; the apparatus performs particularly well when used in a deep cup formed in the furnace wall with the burner tip recessed from the cup surface.

A disadvantage attendant to the '558 apparatus is that when oil is the fuel, oil may accumulate in the burner tip during cold start-up. Additionally, when oil is the fuel, for best operation a separate blower is sometimes required to force atomizing air through the burner housing. Also, when gas is the fuel, the '558 apparatus does not work entirely satisfactorily when used in a shallow cup formed in the furnace wall.

OBJECTS OF THE INVENTION

The principal object of this invention is to provide a dual fuel burner, installable in new or existing furnaces to facilitate user selection of liquid or gas fuel, exhibiting performance superior to the '558 apparatus and being well suited for use in furnaces having relatively shallow burner cups.

SUMMARY OF THE INVENTION

In a burner mountable in a passageway exiting into a furnace including a housing received by the passageway with a discharge end opening into the furnace, a first conduit and a second conduit, where the first conduit is annularly spaced from and within the housing and the second conduit is annularly spaced from and within the first conduit, means for introducing fluids into respective spaces between the housing and the first conduit and between the first and second conduits and into the second conduit, means for inducing swirling motion of fluids discharged from the housing into the furnace and means attached to the first conduit for discharging respective fluids into the furnace through the housing discharge end, this invention provides improved apparatus where the housing extends into the furnace interior, the discharge means is recessed from the housing discharge end and the swirl inducing means is recessed within housing from the discharge means.

The discharge means includes an outer member engaging the first conduit for receipt of first fluid therefrom where the outer member has an open end facing the housing discharge end. Outer periphery of the outer member tapers away from the housing discharge end. An inner member interior of the outer member engages the second conduit for receipt of second fluid therefrom. Axially extending surfaces of the inner and outer members are spaced from one another. The inner member has a cavity-like recess therewithin communicating with the outer member open end, with passageways therethrough connecting the recess with the space between the axially extending surfaces of the inner and outer members. Each channel has a passageway associated therewith where associated channels and passageways communicate with the recess.

The burner exhibits superior operating characteristics over apparatus known heretofore.

DESCRIPTION OF THE PREFERRED EMBODIMENTS

Figure 1:
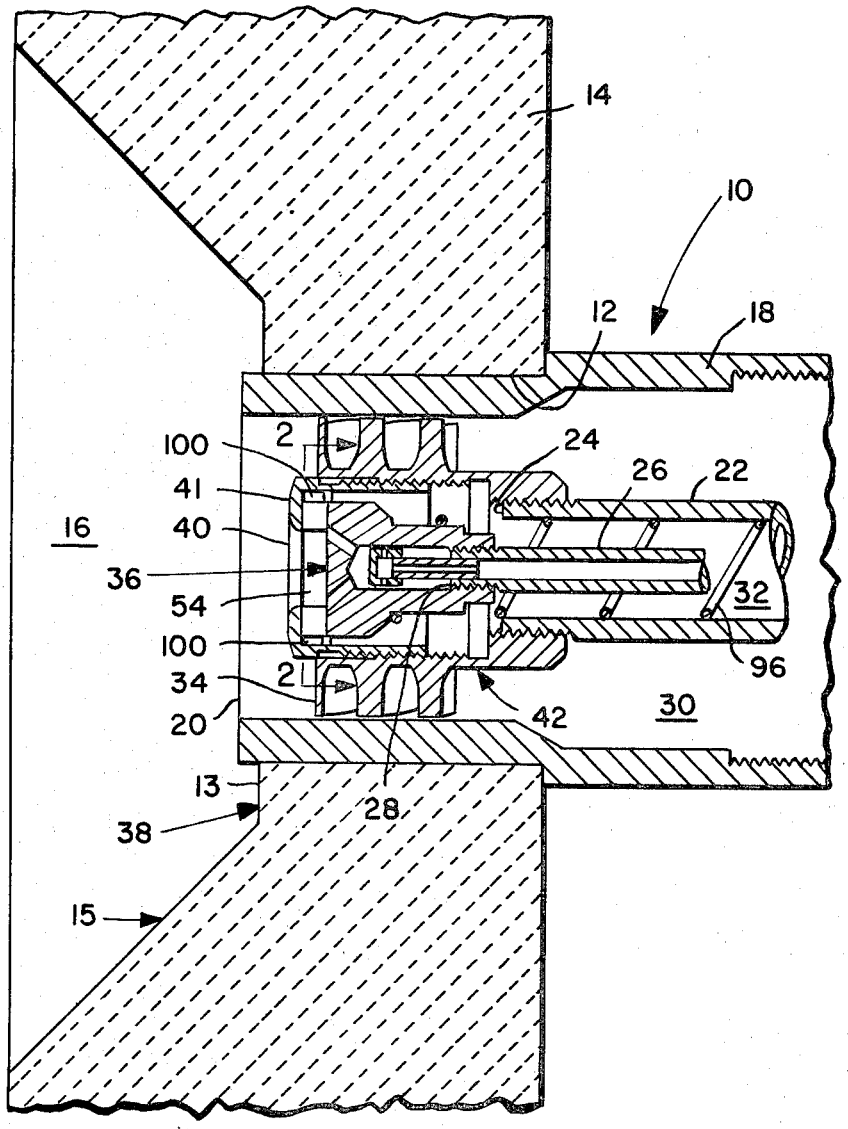
FIG. 1 is a side elevation, in section, of a burner embodying the invention.
Figure 4:
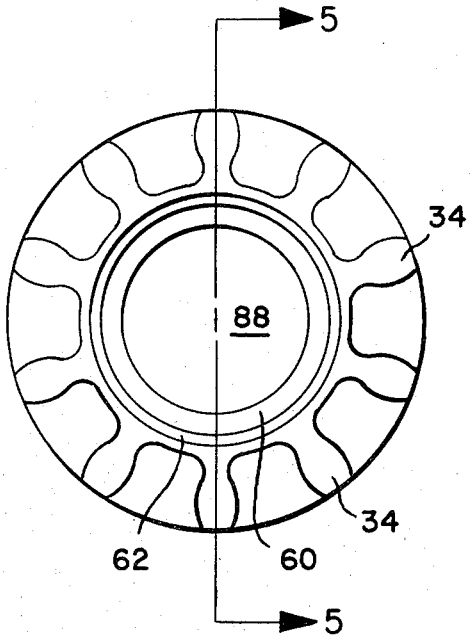
FIG. 4 is a front elevation take from the left hand side in FIG. 1, with some details omitted.

FIG. 1 illustrates a burner manifesting the invention mounted in a passageway exiting into a furnace, where the burner is designated generally 10 and is mounted in a passageway 12 exiting into the furnace through the bottom 13 of a shallow cup 15 formed in a refractory material wall 14 of a furnace having an interior designated generally 16. Burner 10 includes a generally hollow housing 18, of preferably cylindrical configuration, having a discharge end 20 opening into furnace interior 16. A first conduit 22 is within housing 18 and has a discharge end 24 proximate housing discharge end 20. A second conduit 26 is within first conduit 22 and has a discharge end 28 proximate housing discharge end 20. Housing 18, first conduit 22 and second conduit 26 are all preferably coaxial and are respectively spaced annularly; 30 denotes annular space between housing 18 and first conduit 22 while 32 denotes annular space between first and second conduits 22, 26.

The burner includes means for introducing respective fluid fuels into space 32 between first and second conduits 22, 26 and into second conduit 26; the fuel introduction means can also introduce atomizing air into annular space 32. The burner further includes means for introducing combustion air or other gas into space 30 between housing 18 and first conduit 22. These introduction means are remote from the discharge end 20 of housing 18, to the right of structure depicted in FIG. 1 but are not illustrated therein. These introduction means may be of the type disclosed in the '558 patent or of any suitable type known in the art; the fuel and air introduction means do not form part of the invention. The disclosure of U.S. Pat. No. 4,221,558 is hereby incorporated herein by reference.

Burner 10 includes fins 34 between housing 18 and a sleeve 42 affixed to first conduit 22 proximate discharge end 20 of housing 18. Fins 34 induce swirling motion to air traveling from space 30 into furnace interior 16 through discharge end 20. Fins 34 are formed integrally with sleeve 42, as illustrated in FIG. 1.

A nozzle designated generally 36 is in front of discharge end 24 of first conduit 22 and receives and discharges respective fluids from first and second conduits 22, 26 into furnace interior 16 through housing discharge end 20; nozzle 36 can also mix the fluids from the first and second conduits and discharge the fluid mixture.

Discharge end 20 of hollow housing 18 extends into furnace interior 16 past furnace interior surface 38. Nozzle 36 discharges fluid via an orifice 40 in a cap 41 recessed within housing 18 from discharge end 20. Fins 34 are recessed within housing 18 with respect to discharge end 40 of cap 41.

Figure 5:
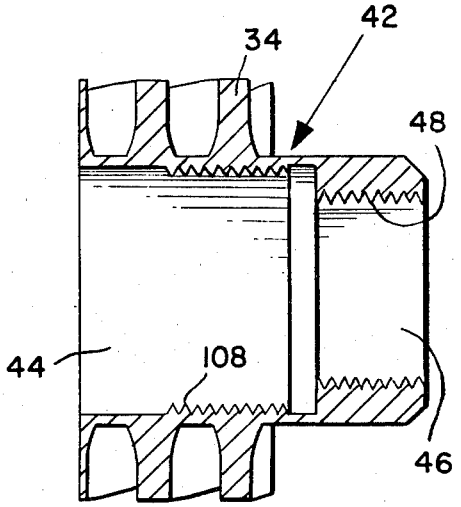
FIG. 5 is a sectional view of a rear portion of the burner illustrated in FIG. 1, taken at 5—5 in FIG. 4, with some details omitted.

Nozzle 36 is within sleeve 42 interior of fins 34, with sleeve 42 receiving first conduit 22 therewithin. Sleeve 42 has portions of greater and smaller inner diameter with the portion of greater inner diameter denoted 44 and the portion of lesser inner diameter denoted 46; see FIG. 5. Internal threads 48 within sleeve portion 46 threadedly engage complemental external threads on the end of first conduit 22 with sleeve 42 thereby receiving first conduit 22; see FIG. 1.

Nozzle 36 is interior of and spaced annularly from unnumbered lateral walls of the larger diameter portion 44 of sleeve 42 and includes a body 50 having a chamber 52 therewithin. Body 50 includes an axial recess 54 therewithin facing discharge end 20 of housing 18. Recess 54 is of generally cylindrical configuration; see FIGS. 2 and 3.

Cap 41 is threaded into internal threads 108 in the larger diameter portion 44 of sleeve 42 and includes an inwardly facing annular lip 56 formed at a discharge end 40 which is proximate housing discharge end 20. Lip 56 has an inwardly facing annular surface 58 which is generally perpendicular to the longitudinal axis of burner 10 and faces nozzle 36. The outwardly facing surface of lip 56, facing oppositely from inwardly facing surface 58 and outwardly towards the furnace interior, has an annular inner portion 60, which is generally perpendicular to the axis of burner 10, and an annular outer portion 62 which is at an angle to portion 60 and tapers away from housing discharge end 20; see FIGS. 1 and 7. Surface 62 preferably tapers from surface 60 at an angle of about 8°, denoted by angle A in FIG. 7. An inner edge 64 of lip 56 curves to provide a smooth, continuous transition from where edge 64 joins surface 60, which is perpendicular to the longitudinal axis of burner 10, to the portion of edge 64 which is parallel to the longitudinal axis of burner 10.

Figure 3:
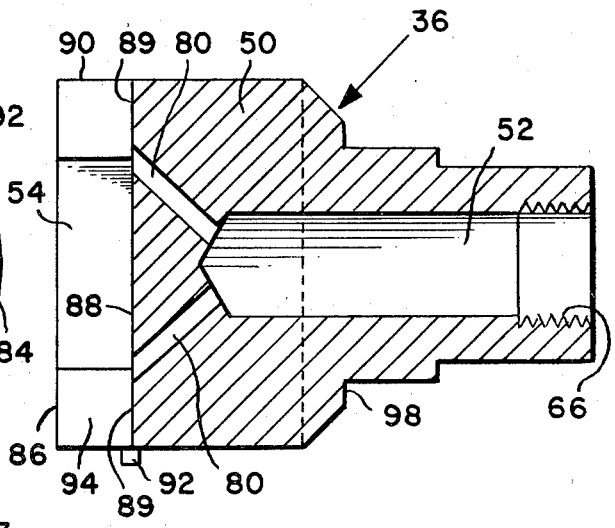
FIG. 3 is an enlarged side elevation in section, taken at 3—3 in FIG. 2, with some details omitted.
Figure 6:
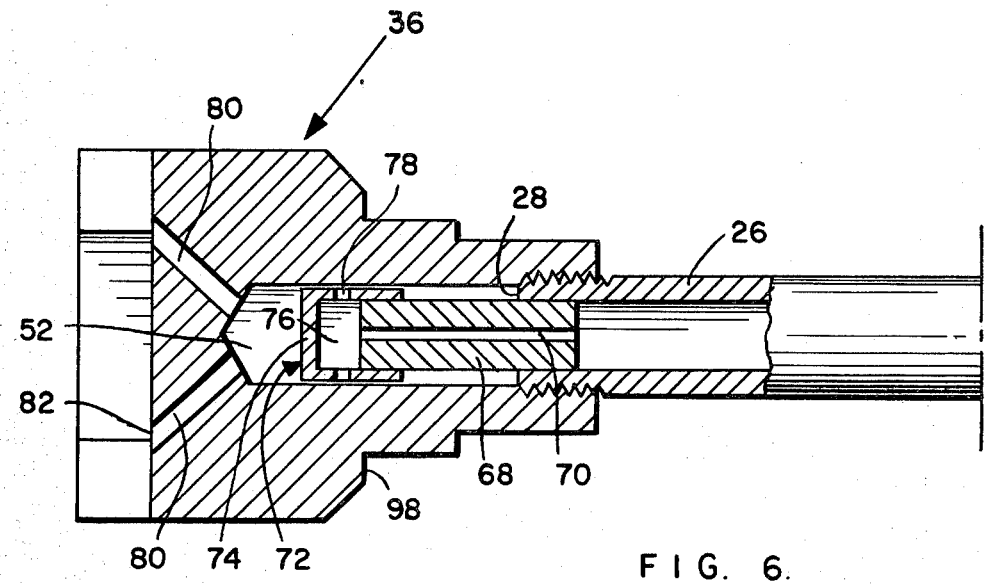
FIG. 6 is a view taken at the same position as FIG. 3, with internal details included.

Nozzle 36 includes internal threads 66 in the rearward portion of chamber 52 for engaging complemental external threads on discharge end 28 of second conduit 26, for receipt of second conduit 26 by chamber 52; see FIGS. 1, 3 and 6.

A feed tube 68 extends from discharge end 28 of second conduit 26 forwardly into a central portion of chamber 52 and includes a small feed orifice 70 extending axially therethrough. Fitted about the unnumbered discharge end of tube 68 is a tip assembly 72 of generally hollow, preferably cylindrical, configuration, having a closed end 74 spaced from feed tube 68 to define an inner chamber 76. Lateral feed orifices 78 in the cylindrical wall of tip assembly 72 permit fuel flow from inner chamber 76 into chamber 52. Orifices 78 are radially disposed with respect to the axis of nozzle 10. Tip assembly 72 fits closely with the wall of chamber 52 so that fuel exiting inner chamber 76 via lateral feed orifices 78 quickly encounters the wall of chamber 52; this contributes to uniform fuel pressure throughout chamber 52.

Passageways 80 transport fuel from chamber 52 out of nozzle 36. Passageways 80 communicate at their discharge ends 82 with cylindrical recess 54 and channels 84 formed in outwardly facing annular surface 86 of nozzle 36. Bottoms of channels 84 are coplanar with circular surface 88 forming the bottom of recess 54. Each passageway 80 terminates at and opens into juncture of circular surface 88 and a respective channel 84. Channels 84 are formed along chords of a circle defining the cylindrical periphery of nozzle 36 in an area 90 of maximum nozzle diameter; see FIGS. 2, 3 and 6.

Spacer pins 92, spaced symmetrically about the axis of burner 10, protrude from nozzle 36 in the area 90 of maximum nozzle diameter to contact a lateral inner surface 94 of cap 41. Pins 92 maintain nozzle 36 spaced annularly within cap 41; see FIGS. 1 and 7.

A spring 96, coiled about second conduit 26, may contact the interior of first conduit 22 and abuts an external rearwardly facing annular shoulder 98 formed on nozzle 36. Spring 96 biases nozzle 36 to the left in FIG. 1, urging outwardly facing annular surface 86 of nozzle 36 into facing contact with inwardly facing surface 58 of lip 56.

When surfaces 58 and 56 are in facing contact, lip 56 covers the otherwise open tops of channels 84 thereby to define closed channels between annular space 100, between cap 41 and nozzle 36, and recess 54.

Cap 41 is threaded into the forward portion of sleeve 42; external threads 106 of cap 41 engage internal threads 108 of sleeve 42; threaded engagement is shown in FIG. 1.

Figure 2:
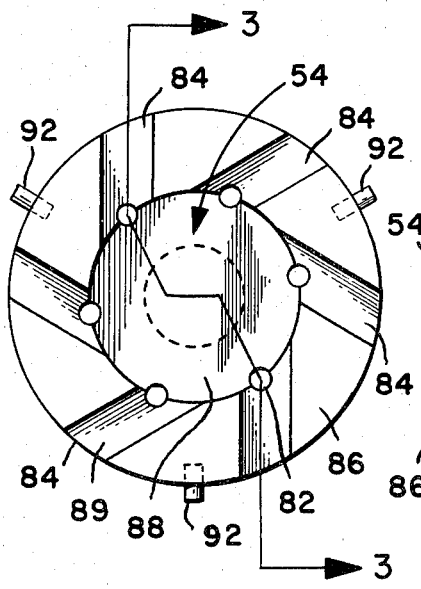
FIG. 2 is a sectional view taken at 2—2 in FIG. 1.

Channels 84 have flat bottoms which are coplanar with the flat circular bottom 88 of recess 54. Channels 84 are preferably straight and are preferably perpendicular to the axis of the burner, however, channels 84 do not intersect the burner axis. Each passageway 80 is associated with a single channel 84; passageways 80 exit into recess 54 and their associated channels 84 at recess-channel juncture, as shown in FIGS. 2 and 3.

Figure 7:
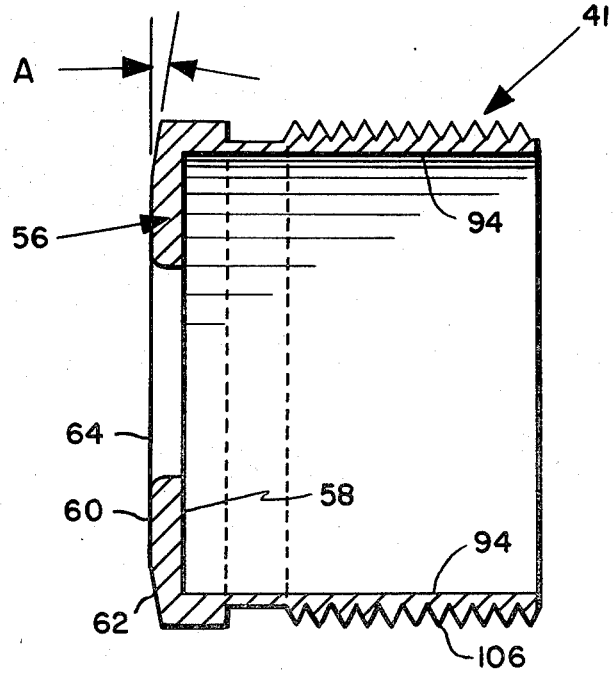
FIG. 7 is a sectional view of a front portion of the burner illustrated in FIG. 1, taken at 5—5, in FIG. 4, with some details omitted.

Taper of surface 62 away from discharge end 20, denoted by angle A in FIG. 7, reduces carbon deposition on external surfaces 60, 62, 64 of lip 56.

Fins 34 are formed integrally with sleeve 42 and preferably snugly contact the cylindrical interior surface of housing 18.

Passageways 80 intersect coplanar surface 88 and flat channel bottoms 89 at approximately 45° angles; see FIGS. 3 and 6.

The internal parts of the burner are preferably stainless steel.

During operation with gas fuel, fuel is normally provided through first conduit 22, filling space 32 and entering recess 54 via channels 84. When oil is the fuel, oil is fed through second conduit 26, occupying chamber 52 and entering recess 54 via passageways 80. Atomizing air is supplied through first conduit 22, filling space 32 and entering recess 54 via channels 84. Action of atomizing air encountering fuel oil at points of communications between passageways 80 and channels 84 produces highly effective atomization of the oil fuel, leading to good combustion efficiency.

During operation of a burner embodying the invention with oil fuel, improved oil atomization is observed. The invention provides highly efficient atomization of #2 fuel oil, using lower atomizing air pressure and providing finer and more uniform oil spray for combustion than known heretofore. Six individual luminous flames, corresponding to passageways 80, form a luminous sheet at fuel feed rates of 400,000 Btu/hr. and above. Flame distribution is more uniform than previously observed. Flames around the tip of the burner have approximately uniform length and appearance. Moreover flames exiting the burner follow the cup-like contour of the furnace interior more closely. Improved radiance of the refractory material interior of the furnace, proximate the burner, has been observed at 400,000 Btu/hr. fuel rates. Some radiance has been observed at 250,000 and 300,000 Btu/hr. fuel rates once the furnace interior has been heated. Additionally performance is more reproduceable from unit to unit. Air pressure drop through the burner is low, permitting use of a single blower for both combustion and atomizing air.

Apparatus embodying the invention exhibits less tendency to accumulate liquid oil upon cold light-up than exhibited by the '558 patent apparatus.

When apparatus embodying the invention is used, as compared to apparatus of the '558 patent, there is less tendency for flames to torch at lower firing rates and less tendency to accumulate carbon on the outwardly facing surface of the cap.

"Stingout" is a term applied to describe forward flow of gas exiting a burner while "wall wiping" is a term applied to describe flow along the furnace wall of gas exiting a burner. Burners of the type of interest are often used in furnaces to heat petrochemicals or other products flowing through tubes within the furnace. To promote uniform temperature along the tubes, which is desirable in order to regulate temperature of the product flowing through the tubes, a uniform temperature profile over the furnace interior wall surface is required. Wall wiping contributes to a uniform temperature profile over the furnace interior wall surface; stingout reduces furnace interior wall surface temperature profile uniformity.

Apparatus embodying the invention, when used in a shallow cup in a furnace wall with gas fuel reduces undesirable stingout and promotes wall wiping; these characteristics are improved over those observed when using the '558 apparatus in a shallow cup with gas fuel.

When gas is the fuel, apparatus of the '558 patent operates satisfactorily only to a fuel flow rate of about 300,000 Btu/hr. while apparatus embodying the invention operates very well at fuel flow rates up to 800,000 Btu/hr. In apparatus embodying the invention wall wiping has been observed at fuel flow rates of about 400,000 Btu/hr. and above in a hot furnace, reducing stingout significantly.

What is claimed is:

1. In a burner mountable in a passageway exiting into a furnace, including:

a. a housing, received by said passageway, opening into said furnace;
b. a first conduit within said housing;
c. a second conduit within said first conduit;
d. means for introducing first fluid between said first and second conduits;
e. means for introducing second fluid into said second conduit;
f. means for introducing third fluid between said housing and said first conduit;
g. means proximate said housing opening, for inducing swirling motion to third fluid discharged from said housing into said furnace;
h. means attached to said first conduit for discharging said first and second fluids into said furnace through said housing opening;

the improvement comprising:

i. said housing opening extending into said furnace;
j. said discharge means being recessed within said housing;
k. said swirl-inducing means being recessed within said housing from said discharge means outlet;
l. said discharge means including:
  1. an outer member receiving said first fluid from said first conduit, having an open end facing said housing opening, said outer member about said open end tapering away from said housing opening;
  2. an inner member, interior of and spaced from said outer member, receiving said second fluid from said second conduit, including
    i. a cavity therewithin communicating with said outer member open end;
    ii. passageways therethrough connecting said second conduit with said cavity;
    iii. channels therethrough connecting said cavity with said space between said inner and outer members;

wherein associated channels and passageways communicate with said cavity at a common location.

2. In a burner mountable in a passageway leading into a furnace, including:

a. a hollow housing received by said passageway, having a discharge end opening into said furnace;
b. a first conduit, within said housing;
c. a second conduit, within said first conduit;

wherein said housing, said first conduit and said second conduit are respectively annularly spaced;

d. means for introducing respective fuels into space between said first and second conduits and into said second conduit;
e. means for introducing a gas into space between said housing and said first conduit;
f. fins within said housing, proximate said housing discharge end, for inducing swirling motion of gas discharged from said housing into said furnace;
g. means for discharging respective fuels from said first and second conduits into said furnace through said housing discharge end;

the improvement comprising:

h. said housing discharge end extending into the furnace interior;
i. said discharge means being recessed within said housing from said housing discharge end;
j. said discharge means comprising:
  1. a sleeve receiving said first conduit therewithin and extending forwardly therefrom;
  2. a cap connected to the end of said sleeve proximate said housing discharge end, including an inwardly facing lip about a discharge end thereof proximate said housing discharge end, said lip defining the outlet end of said discharge means; and
  3. a nozzle interior of and spaced annularly from said sleeve, connected to the discharge end of said second conduit, including:
    a. a chamber therewithin communicating with said second conduit;
    b. a recess facing said housing discharge end, recess periphery contacting said lip of said cap;
    c. channels therewithin extending from space between said sleeve and said nozzle into said recess, channel orientation being defined by half chords of a circle having a center at the longitudinal axis of said nozzle;
    d. conduits connecting said chamber and said channels; and k. said fins being recessed within said housing from the outlet end of said discharge means.

3. In a burner for mounting in a passageway leading into a furnace, including:

a. a hollow housing complementally received by said passageway, having a discharge end opening into said furnace;

b. a first conduit, within said housing, having a discharge end proximate said housing discharge end;

c. a second conduit, within said housing, having a discharge end proximate said housing discharge end;

wherein said housing, said first conduit and said second conduit are respectively annularly spaced apart, d. means for introducing respective fuels into space between said first and second conduits and into said second conduit;

e. means for introducing air into space between said housing and said first conduit;

f. fins within said housing, proximate said housing discharge end, for inducing swirling motion of air discharged from said housing into said furnace;

g. means, at said discharge end of said first conduit, for discharging respective fuels from said first and second conduits into said furnace through said housing discharge end;

the improvement comprising:

h. said housing discharge end extending into the furnace interior;

i. said discharge means being recessed within said housing from said housing discharge end;

j. said discharge means further comprising:

1. a sleeve threadedly engaging said first conduit discharge end for receipt of fluid from said first conduit by said sleeve interior;

2. a cap forward of said sleeve, threadedly engaging said sleeve and coaxial with said cap, having a radially inwardly extending annular lip about a cap discharge end proximate said housing discharge end, an inner circular edge of said lip defining a discharge means outlet;

3. a nozzle within and annularly spaced from a lateral wall of said sleeve, connected to the discharge end of said second conduit, including:

i. a chamber therewithin communicating with said second conduit for receipt of fluid therefrom;

ii. a cylindrical recess formed therein facing said housing discharge end, the recess cylindrical wall being aligned with said inner circular edge of said lip;

iii. channels formed therewithin connecting annular space between said sleeve and said nozzle with said recess, said channels having flat bottoms, channel sides being normal to said channel bottoms, said channel bottoms being coplanar with the bottom surface of said recess;

iv. conduits connecting said chamber with said channels and said recess, said conduits communicating with respective channels at channel-recess juncture;

k. said lip abutting said nozzle about said recess and covering said channels to thereby define closed tops of said channels;

l. said fins being recessed within said housing from said discharge means outlet end.

4. Apparatus of claim 3 wherein said lip has a curved inner edge.

5. Apparatus of claim 4 wherein said nozzle and said housing are coaxial and said edge curves substantially continuously from orientation substantially parallel said axis to orientation substantially perpendicular to said axis and coplanar with the surface of said lip facing said furnace interior.

6. Apparatus of claim 5 wherein said channels are normal to the axis of said nozzle.

7. Apparatus of claim 3 wherein the radially outer periphery of said lip tapers away from said housing discharge opening.

8. Apparatus of claim 7 wherein said channels are defined by partial chords of a circle having a center at the axis of said nozzle.

9. Apparatus of claim 3 wherein said nozzle has an external annular shoulder formed thereon facing oppositely from said housing discharge end; wherein said discharge means outlet end is intermediate said shoulder and said housing discharge end; wherein said apparatus further comprises means contacting said shoulder for biasing said nozzle towards said housing discharge end, against said lip.

10. Apparatus of claim 9 wherein said bias means is a coil spring aligned with said axis.

* * * * *